US008878443B2

(12) United States Patent
Luo et al.

(10) Patent No.: US 8,878,443 B2
(45) Date of Patent: Nov. 4, 2014

(54) COLOR CORRELATED TEMPERATURE CORRECTION FOR LED STRINGS

(75) Inventors: Hong Luo, San Jose, CA (US); Joe Bernier, Cambridge, MA (US); Shiyong Zhang, Acton, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 155 days.

(21) Appl. No.: 13/444,242

(22) Filed: Apr. 11, 2012

(65) Prior Publication Data

US 2013/0271018 A1 Oct. 17, 2013

(51) Int. Cl.
*H05B 37/02* (2006.01)

(52) U.S. Cl.
USPC ..... 315/185 R; 315/153; 315/291; 315/308

(58) Field of Classification Search
USPC ..... 315/291, 307, 224, 247, 50, 312, 309, 315/311, 126
See application file for complete search history.

(56) References Cited

U.S. PATENT DOCUMENTS

| | | | |
|---|---|---|---|
| 4,952,949 A | 8/1990 | Uebbing | |
| 5,627,472 A | 5/1997 | Ofer et al. | |
| 7,119,500 B2 | 10/2006 | Young | |
| 7,262,559 B2 | 8/2007 | Tripathi et al. | |
| 7,712,925 B2 | 5/2010 | Russell | |
| 7,781,983 B1 | 8/2010 | Yu et al. | |
| 7,863,829 B2 | 1/2011 | Sayers et al. | |
| 2006/0006821 A1 | 1/2006 | Singer et al. | |
| 2011/0068701 A1 * | 3/2011 | van de Ven et al. | 315/185 R |
| 2012/0032612 A1 * | 2/2012 | Antony et al. | 315/297 |
| 2012/0248995 A1 | 10/2012 | Bakk et al. | |

FOREIGN PATENT DOCUMENTS

| | | |
|---|---|---|
| WO | 2011054547 A1 | 5/2011 |
| WO | 2011067177 A1 | 6/2011 |
| WO | 2011098334 A1 | 8/2011 |
| WO | 2011101282 A1 | 8/2011 |

* cited by examiner

*Primary Examiner* — Thienvu Tran
*Assistant Examiner* — Christopher Lo
(74) *Attorney, Agent, or Firm* — Edward S. Podszus

(57) ABSTRACT

An array of LEDs having output light in different wavelength ranges. A control circuit connected to the array includes a temperature variable resistance component and a switch selectively connecting the component to the array. The control circuit limits the current applied to at least some of the LEDs during initial energization of the LEDs prior to steady-state operation of the LEDs. Variations over time of a color correlated temperature (CCT) of output light of the energized array are reduced.

16 Claims, 6 Drawing Sheets

COLOR CORRELATED TEMPERATURE CORRECTION FOR LED STRINGS

BACKGROUND

The present disclosure relates to color mixing of LEDs and providing a consistent color correlated temperature (CCT) from initial energization of the LEDs to steady-state operation.

PRIOR ART

Color-mixing is used in LED light engines to achieve better CRI (color rendering index) or efficacy or color controllability. When no color control is implemented, a light engine is configured in such a way that the required color coordinates are met under steady-state temperature operation by a combination of a fixed number of LEDs of different colors having fixed drive currents for each LED color. When the LEDs are energized, the LEDs are initially at ambient temperature and gradually heat up over time. Therefore, the CCT/color coordinates of the LEDs are not at the desired region upon startup. For example, for green/red LED mixing, the light appears to be reddish when initially turned on. After the LEDs have warmed up and under steady-state temperature operation, the reddish light diminishes because the red light decreases more with temperature increase and the light gradually reaches the targeted CCT and color coordinates. However, the reddish light output can be perceived as less desirable by some users when the LEDs are initially energized.

It is known to implement pulse width modulation (PWM) in a light engine. For example, a variable frequency shunting switch having a duty cycle modulated by the LED operating temperature adjusts the average current applied to various colored LEDs. The amount of average current is proportional to the duty cycle of the PWM. This approach can control the color of the light engine. However, this circuit configuration can be comparatively more complicated and expensive than alternative solutions. An example of a PWM control for an LED device is shown in U.S. Published Patent Application 2006/0006821 (Singer).

It is know to implement passive control by means of a positive temperature coefficient (PTC) thermistor in a light engine to shunt a portion of the current applied to the LEDs. Thus, when connected in parallel to an LED string, a portion of the current is shunted by the PTC thermistor such that, as the temperature increases, the current to the LED string increases. However, a PTC thermistor connected in parallel to the LED string will consume power (varying from several hundreds of milliwatts to several watts, depending on the resistance of the PTC thermistor) which decreases the efficiency of the light engine.

The following are also know in the prior art: U.S. Pat. No. 7,781,983 (Yu); U.S. Pat. No. 7,712,925 (Russell); U.S. Pat. No. 7,119,500 (Young); U.S. Pat. No. 4,952,949 (Uebbing); and U.S. Pat. No. 7,262,559 (Tripathi).

SUMMARY

In one embodiment, a light engine comprises an array of LEDs, a power supply and a control circuit. The array of LEDs comprises at least one first string of first LEDs connected in series which, when energized, output light having a first wavelength range. The array of LEDs comprises at least one second string of second LEDs connected in series which, when energized, output light having a second wavelength range different from the first wavelength range. The second string is connected in series with the first string. The power supply connects to the array and is for connection to a power source for energizing the LEDs. The control circuit is connected to the array and comprises a temperature variable resistance component and a switch selectively connecting the NTC component to the array. The control circuit controls the switch as a function of a temperature circuit indicative of the temperature of at least one of the LEDs. The control circuit limits the current applied to at least some of the LEDs during initial energization of the LEDs prior to steady-state operation of the LEDs so that variations over time of a color correlated temperature (CCT) of output light of the energized array are reduced.

In one embodiment, a light engine comprises first and second strings of LEDs, a power supply and a control circuit. The first string of first LEDs is connected in series which, when energized, output light having a first wavelength range. The second string of second LEDs is connected in series which, when energized, output light having a second wavelength range different from the first wavelength range. The second string is connected in series with the first string. The power supply connected to the first and second strings for connection to a power source energizes the strings. The control circuit comprises a temperature circuit providing a temperature signal indicative of the temperature of at least one of the LEDs. The control circuit is responsive to the temperature circuit for selectively controlling a current applied to the second string via the power supply as a function of the temperature signal. The control circuit controls the current during initial energization of the LEDs prior to steady-state operation of the LEDs. As a result, variations over time of a color-correlated temperature (CCT) of the output light of the energized LEDS are reduced.

Other objects and features will be apparent and pointed out hereinafter.

BRIEF DESCRIPTION OF THE DRAWINGS

Corresponding reference characters indicate corresponding parts throughout the drawings.

DETAILED DESCRIPTION

Figure 1:
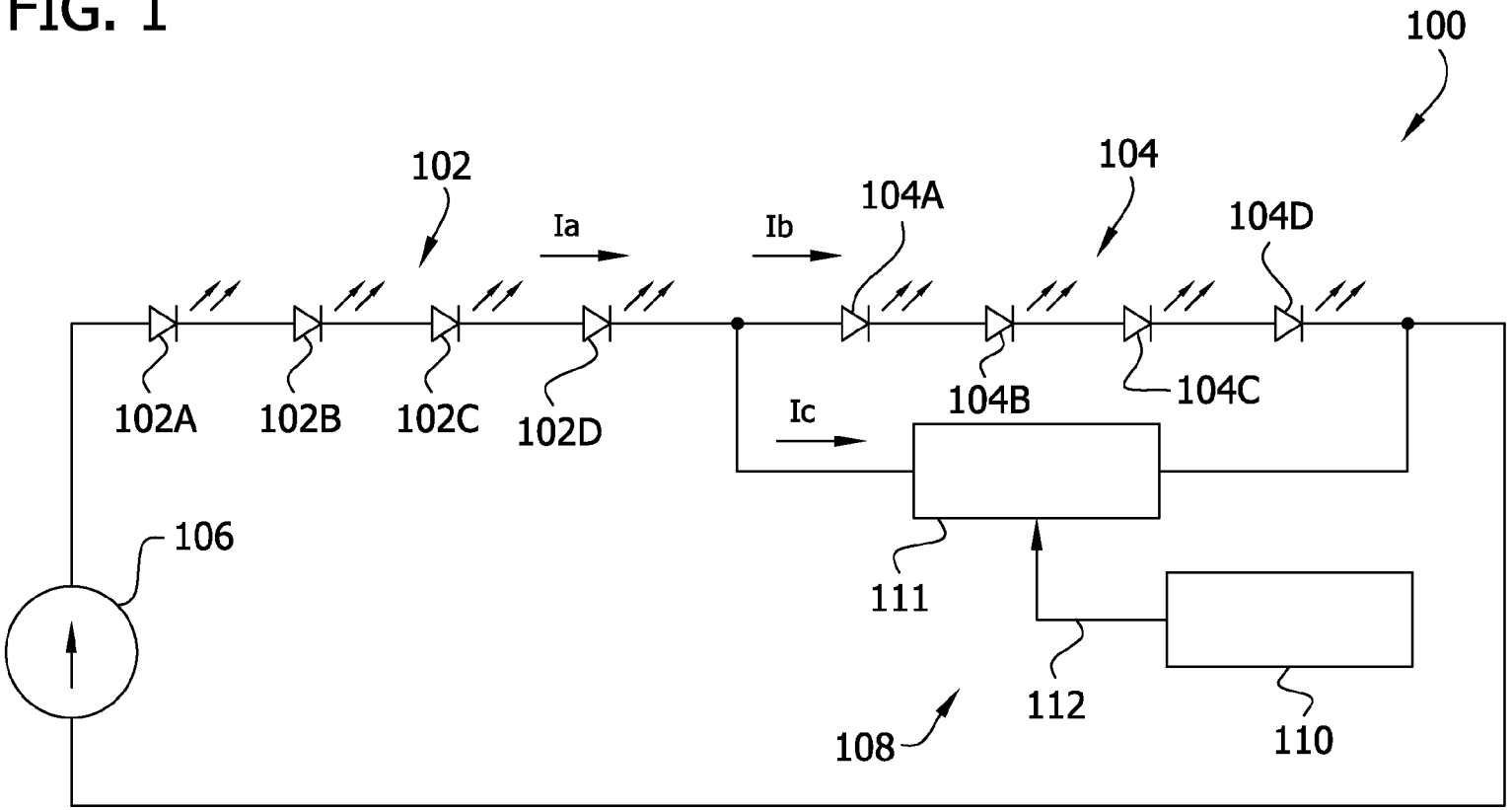
FIG. 1 is a diagram, partially in block form, of one embodiment.

FIG. 1 is a diagram, partially in block form, of one embodiment. A light engine 100 comprises a first string 102 of first LEDs 102A-102D connected in series and a second string 104 of second LEDs 104A-104D connected in series, although more than two strings may be connected in series. When the first string 102 is energized by a power supply 106, it provides an output light having a first wavelength range. When the second string 104 is energized by the power supply 106, it provides an output light having a second wavelength range different from the first wavelength range. As illustrated, the second string 104 is connected in series with the first string 102. The power supply 106 connected to the first and second strings is connected to a power source not shown for energizing the strings.

The light engine 100 also includes a control circuit 108 comprising a temperature circuit 110 providing a temperature signal 112 indicative of the temperature of at least one of the LEDs 102A-D, 104A-D. Examples of the temperature circuit 110 are noted below with regard to FIGS. 2 and 3 (see temperature sensitive circuits 208 and 308). Because the temperature signal 112 corresponds to the temperature of at least one of the LEDs 102A-D, 104A-D, the signal 112 indicates when the temperature stabilizes and the control circuit 108 responds to the temperature signal 112 as noted below.

The control circuit 108 includes a current limiting circuit 111 responsive to the temperature circuit 110 for selectively controlling a current applied to the second string 104 by the power supply 106. The current limiting circuit 111 operates in response to (i.e., as a function of) the temperature signal 112. In particular, the circuit 111 responds to the temperature signal 112 to control the current during initial energization of the LEDs 102, 104 prior to steady-state operation of the LEDs 102, 104. As noted below, the control circuit 108 diverts some of the current that passes though the second string 104 during start-up and prior to steady-state operation. As a result, variations over time from start-up to steady state of a color correlated temperature (CCT) of output light of the energized LEDS 102, 104 is reduced.

In one embodiment, the first string 102 of first LEDs 102A-102D emit light in the first wavelength range which includes green light and the second string 104 of second LEDs 104A-104D emit light in the second wavelength range which includes red light. As a result, the combination of red and green light appears to an observer as yellow or white light. For example, the red (e.g., amber) light may have a dominant wavelength of 625 nm which is within a red range of 590 nm to 750 nm. The green (e.g., mint) light may have a dominant wavelength of 510 nm which is within a green range of 475 nm to 570 nm. Although the illustrations herein show red and green LEDs in combination, it is contemplated that other color combinations of LEDs emitting two or more different colors may be used. For example, a string may have LEDs emitting light in three or more different wavelength ranges. In addition, additional LEDs emitting light other than red or green may be simultaneously energized with the red and green LEDs as part of the same circuit or different circuits.

Figure 2:
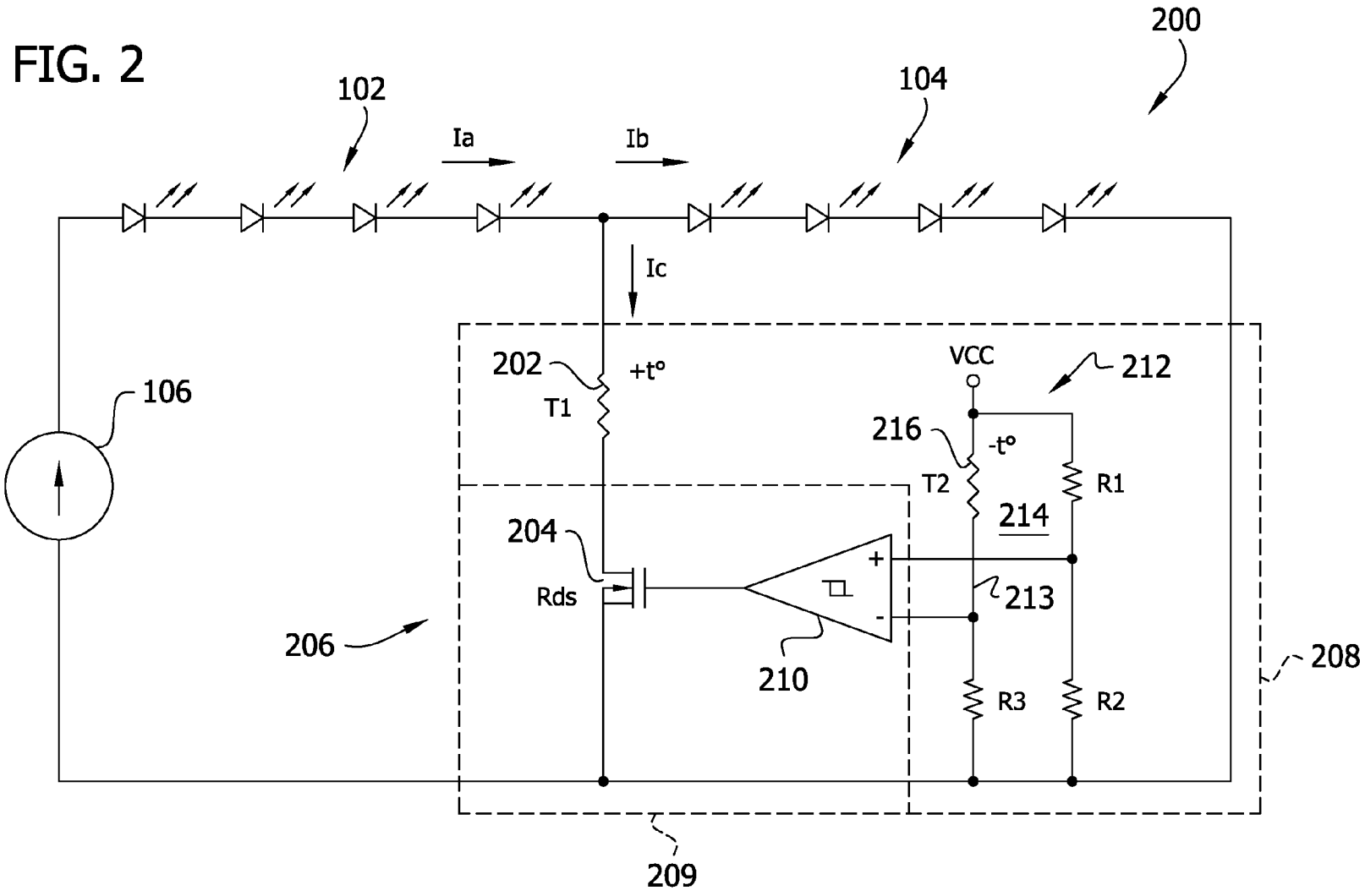
FIG. 2 is schematic diagram of one embodiment using two temperature sensitive components.
Figure 3:
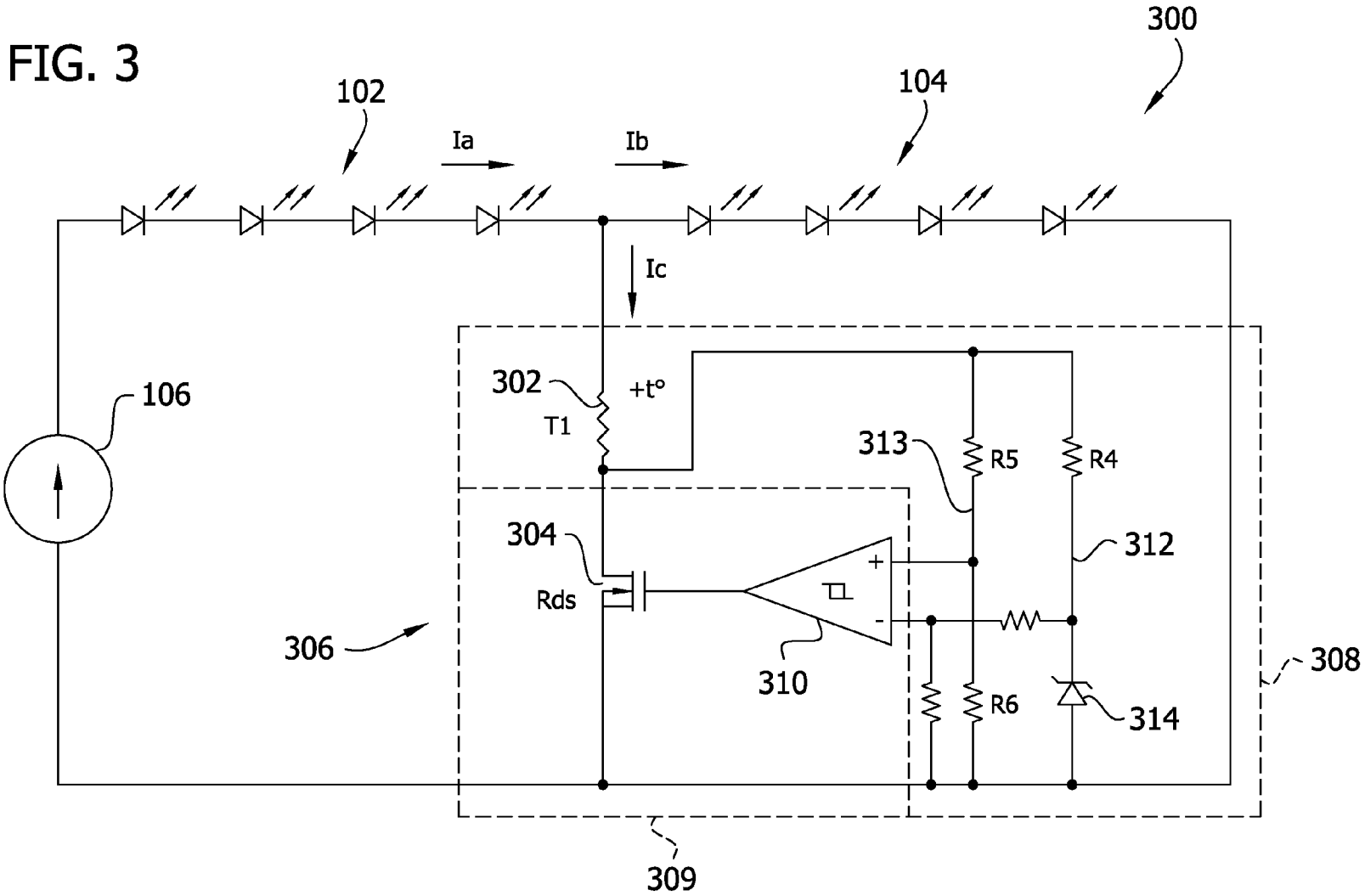
FIG. 3 is schematic diagram of one embodiment using one temperature sensitive component.
Figure 4:
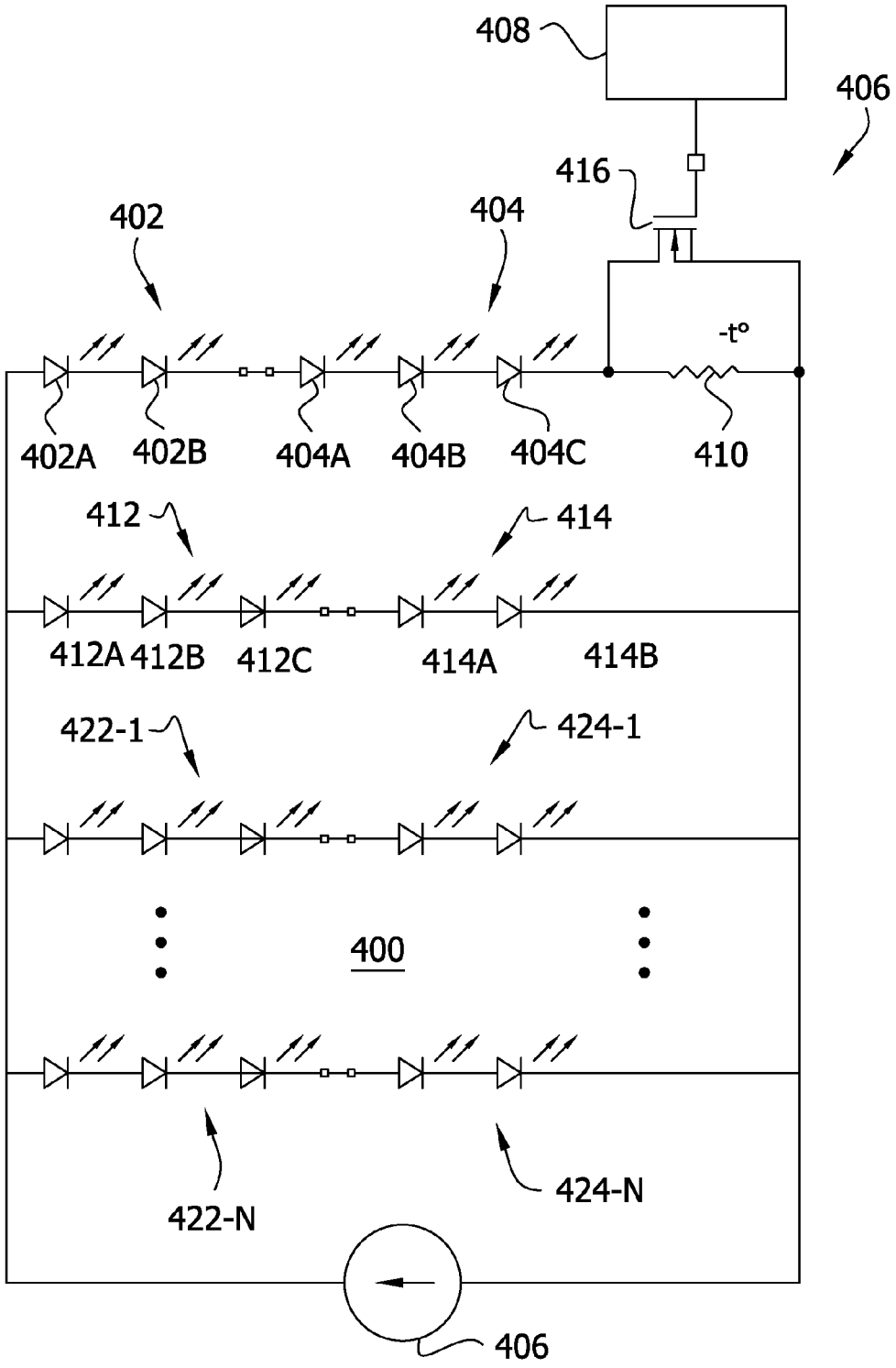
FIG. 4 is schematic diagram of one embodiment having multiple parallel LED strings.

In operation of FIG. 1, the temperature sensitive circuit 110 monitors the temperature variation of the first string 102 while the temperature circuit 110 adjusts the current limiting circuit 111 to ensure the targeted CCT or color coordinates are met. In FIGS. 2 and 3, the current is limited by shunting a portion of the current applied to string 104. In FIG. 4, the current is limited by a temperature sensitive variable resistor (see 410) in series with strings 402, 404. When the power supply 106 is connected to a power source, the strings 102, 104 are energized and initially begin to emit light. Some LEDs change color and/or intensity during the first 3-5 minutes of energization and require up to 30 minutes or more (i.e., about 30 minutes) to reach steady state operation. Generally, an LED light array may need a longer time to reach steady state. Depending on the design and configuration, the array may require 30 minutes, or one hour or even two hours or more to reach steady state. For convenience, "about 30 minutes" is used herein to refer to the period of time to reach steady state.

During this start-up period prior to steady state operation, a current Ia flows through the first string 102 and the current limiting circuit 111 diverts at least a proportional part of the current Ia so that less than all of the current Ia flows through the second string 104. Thus, the current limiting circuit 111 diverts current Ic so that Ia−Ic=Ib flows through the second string 104 during start-up. The temperature circuit 110 provides a temperature signal 112 to the current limiting circuit 111. The temperature signal 112 corresponds to the temperature or state of operation of the strings 102, 104. The current limiting circuit 111 is responsive to the temperature signal 112. When the LEDs have reached steady state operation, as indicated by the temperature signal 112, limiting by the current limiting circuit 111 is substantially reduced or eliminated so that all or substantially all current Ia flows through the second string 104.

In one embodiment, the temperature signal 112 is indicative of the state of operation of only the first string 102. For example, assume that the first string 102 is a green string that emits green light and the second string 104 is a red string that emits red light. At start-up, the red light from the red string would appear more dominant so that the total light output of the green and red strings would have a reddish appearance to an observer. To minimize this, the current supplied to the red string is shunted by the current limiting circuit 111 to reduce the intensity of the red light. As a result, during start-up the total light output of the green and red strings would have a yellow (mixed green and red) appearance to an observer. As the green string warms up and approaches steady state, the temperature signal 112 changes. The current limiting circuit 111 responds to the change to reduce the amount of shunted current Ic. When the temperature signal 112 indicates that the green string has reached its steady state, the current limiting circuit 111 responds to substantially or completely eliminate the amount of shunted current Ic.

Referring to FIGS. 2 and 3, embodiments of the temperature circuit 110 are illustrated in two different light engines 200, 300. In each light engine, the control circuit 108 comprises a temperature variable resistance component such as a PTC (positive temperature coefficient) component 202, 302 (e.g., a PTC thermistor) in parallel with the second string 104 and in series with a switch 204, 304. In one embodiment, the switch 204,304 may be a variable resistance switch (e.g., a MOSFET). In this configuration, a temperature sensitive circuit 208 controls the switch 204, 304 so that the PTC component 202, 302 in combination with the switch 204, 304 shunts the current applied to the second string 104 during initial energization of the LEDs 102, 104 prior to steady-state operation of the LEDs 102, 104. As the LEDs heat up, shunting is reduced. During steady-state operation of the LEDs, shunting by the PTC component is substantially reduced or eliminated.

FIG. 2 is schematic diagram of one embodiment of light engine 200 using two temperature sensitive components. In FIG. 2, the control circuit 108 is illustrated as comprising a shunting circuit 206 for shunting a portion of the current applied to the second string 104. As shown, the shunting circuit 206 comprises a temperature sensitive circuit 208 and a switching circuit 209. The temperature sensitive circuit 208 is connected between the first string 102 and second string 104 for shunting the portion of the current applied to the second string 104. The switching circuit 209 comprises a switch 204 controlled by a comparator 210. The switch 204 is in series with a variable temperature sensitive component of the temperature sensitive circuit 208 for selectively disabling the temperature variable resistance component 202 and thus disabling the shunting circuit 206. As shown in FIG. 2, the variable temperature sensitive component is a PTC thermistor 202. When disabled, the PTC thermistor 202 does not shunt or otherwise control any substantial current in the second string 204.

The switching circuit 209 of the light engine 200 includes a MOSFET 204 in series with at least a part of the first temperature sensitive circuit 208 for selectively providing an open circuit. The switching circuit 209 also includes a comparator 210 responsive to a second temperature sensitive circuit 212 for controlling the MOSFET 204. The second temperature circuit 212 is a part of the first temperature sensitive circuit 208. The first temperature sensitive circuit 208 comprises a positive temperature coefficient (PTC) component 202 connected in series with the MOSFET 204. The second temperature sensitive circuit comprises a voltage circuit 214 including a constant voltage source VCC and second temperature variable resistance component. As shown in FIG. 2, the second temperature variable resistance component is a negative temperature coefficient (NTC) component 216 connected to the constant voltage source VCC. The NTC component 216 is connected to an input of the comparator 210 for controlling the MOSFET 204. Thus, in this light engine 200 the control circuit 108 comprises the PTC thermistor 202 and the MOSFET 204 in series with the PTC thermistor 202 responsive to the comparator 210 controlling the switch MOSFET 204. The PTC thermistor 202 and the MOSFET 204 are in parallel with the second string 104.

In operation of FIG. 2, the temperature sensitive circuit 208 monitors the temperature variation of the first string 102 while the PTC component 202 and MOSFET 204 adjust the shunting current to ensure the targeted CCT or color coordinates are met. When the power supply 106 is connected to a power source, the strings 102, 104 are energized and initially begin to emit light. Some LEDs change color and/or intensity during the first 3-5 minutes of energization and require about 30 minutes to reach steady state operation. During this start-up period prior to steady state operation, a current Ia flows through the first string 102 and the PTC component 202, e.g., thermistor T1, and MOSFET 204 divert at least part of the current Ia so that less than all of the current Ia flows through the second string 104. Thus, the PTC component 202 and MOSFET 204 divert current Ic so that Ia−Ic=Ib flows through the second string 104 during start-up.

The thermistor T1 and MOSFT 204 are selected to have properties which correspond to the properties of the first string 102. Initially, the thermistor T1 has a low resistance. As the thermistor T1 diverts current, it heats up and its resistance increases to a maximum over a period of time. Similarly, as noted below, the comparator 210 causes the drain to source resistance Rds of the MOSFET 204 to increase to a maximum over the period of time. The period of time is selected to be about the same as the period of time that it takes for the second string 104 to reach steady state operation.

The NTC component 216, e.g., NTC thermistor T2, provides a temperature signal 213 to the comparator 210. The temperature signal is the voltage drop across thermistor T2 caused by the fixed voltage VCC applied to thermistor T2. Initially, the resistance of thermistor T2 is high so the voltage applied to the negative input of the comparator 210 is much less than VCC and much less that the fixed voltage applied to the positive input to the comparator 210 by voltage divider resistors R1 and R2. As a result, the initial output of the comparator 210 is high resulting in the voltage applied to the gate of the MOSFET 210 to be high. This high gate voltage causes the drain to source resistance Rds of the MOSFET 204 to be low. The initially low resistance of the thermistor T1 and the initially low Rds resistance of the MOSFET 204 limits the current applied to string 104 by shunting or conducting current Ic.

As the thermistor T2 conducts current and increases in temperature, its resistance decreases so that the voltage applied to the negative input of the comparator 210 increases and approaches VCC. This increase results in an decrease in the output voltage of the comparator 210 applied to the gate of the MOSFET 204. As the gate voltage decreases, the drain to source resistance Rds of the MOSFET 204 increases so that the MOSFET conducts less current. Simultaneously, the resistance of the thermistor T1 increases as it conducts current so that the thermistor T1 also conducts less current. Thus, as the circuit continues to operate and approach steady state, the thermistor T1 and MOSFET 204 increases the resistance to reduce the amount of current shunted from string 104.

The voltage drop VT2 across NTC thermistor T2 is equal to VCC minus the voltage drop VR3 across resistor R3 (VR3), i.e., VT2=VCC−VR3. Since VR3=VCC*R3/(RT2+R3), as the resistance RT2 across NTC thermistor T2 decreases, VR3 increases and VT2=VCC−VR3 decreases. Thus, as the circuit continues to operate and approach steady state, the resistance RT2 of NTC thermistor T2 decreases causing the voltage drop across T2 to decrease. Thus, the voltage applied to the negative input of the comparator 210 becomes higher than the fixed voltage applied to the positive input of the comparator 210. This causes the comparator output to be reduced causing Rds to increase. As the circuit continues to operate and approach steady state, the resistance of PTC thermistor T1 increases. As the circuit continues to operate and approach steady state, the increased resistance of PTC thermistor T1 and the increased resistance of the Rds of the MOSFET 204 discontinues any current limiting or shunting so that full current Ia is applied to the string 104. Thus, any losses due to the thermistor T1 are essentially eliminated.

The period of time it takes for thermistor T1 to reach its maximum resistance, for Rds to reach its maximum resistance and for the thermistor T2 to reach its minimum resistance is selected to be about the same as the period of time that it takes for the second string 104 to reach steady state.

The temperature signal 213 corresponds to the temperature or state of operation of string 102. The comparator 210 is responsive to the temperature signal 213.

Essentially, the comparator 210 compares the voltage drops across thermistor T2 and resistor R1. As the thermistor T2 resistance decreases, the voltage drop across T2 decreases. This will result in an increase in the output of the comparator 204 and of the drain to source resistance of the MOSFET, forcing more current to go through the second string 104. At a certain point in time, thermistor T1 reaches its maximum and the MOSFET will be fully off (an open circuit), so that substantially all the current Ia will go through the second string 104. This point in time is selected to correspond to about the time when the first string 102 reaches steady state.

Alternatively, if a different switch such as a transistor switch is used instead of the MOSFET 204, the thermistor T1 may be selected to have properties which correspond to the properties of the first string 102. Alternatively, thermistor T2 may be replaced by a PTC thermistor. In this embodiment, the PTC thermistor is connected to the positive input of the comparator 210 and the resistance budge R1, R2 is connected to the negative V input.

As a specific embodiment, consider the first string 102 to be green LEDs and the second string 104 to be red LEDs. Thermistors T1 and T2 and MOSFET 204 are selected so that the shunted current $I_c$ varies with temperature in such a way that the light emitted from the first green string 102 and the second red string 104 are balanced to maintain a consistent CCT/color coordinates over the operating temperature. Both the green LEDs and the red LEDs become relatively less bright with increasing temperature. However, the green LED output decreases at a slower rate less than the red LED output, resulting in an increase of the percentage of green light in the total light output of the circuit. As a result, as the circuit continues to warm up and reach steady state, the percentage of green light in the total light output increases. Simultaneously, less current is shunted from string 104 so that the red LEDs also become relatively brighter. This maintains a balance in the light output between the green and red LEDs to maintain consistent CCT/color coordinates as the circuit warms up. The second temperature sensitive circuit 212 including thermistor T2 and associated components are selected such that when the light engine temperature reaches a threshold value (the steady-state operating temperature), the comparator 210 changes state, resulting in the MOSFET 204 turning off and the shunting current $I_c$ going to zero.

FIG. 3 is schematic diagram of one embodiment of light engine 300 using one temperature sensitive component. In FIG. 3, the control circuit 108 is illustrated as a shunting circuit 306 for shunting a portion of the current applied to the second string 104. As shown, the shunting circuit 306 comprises a temperature sensitive circuit 308 and a switching circuit 309. The temperature sensitive circuit 308 is connected between the first string 102 and second string 104 for shunting the portion of the current applied to the second string 104. The switching circuit 309 comprises a switch 304 controlled by a comparator 310. The switch 304 is in series with a PTC thermistor 302 of the temperature sensitive circuit 308 for selectively disabling the PTC thermistor 302 and thus disabling the temperature sensitive circuit 308. When disabled, the temperature sensitive circuit 308 does not substantially shunt or otherwise control any substantial current in the second string 104.

The temperature sensitive circuit 308 of the light engine 300 comprises the PTC thermistor 302 connected between the first and second strings and a voltage circuit, such as a resistive array 312. The switching circuit 309 includes a MOSFET 304 in series with the PTC thermistor 302 for selectively providing an open circuit. The switching circuit 309 also includes a comparator 310 responsive to the voltage circuit 312 for controlling the MOSFET 304. The resistive array 312 is connected to inputs of the comparator 310. Thus, in this light engine 300 the control circuit 108 comprises the PTC thermistor 302 and the MOSFET 304 in series with the PTC thermistor 302 responsive to the comparator 310 controlling the switch. The PTC thermistor 302 and the MOSFET 304 are in parallel with the second string 104.

In operation, FIG. 3 operates similarly to FIG. 2. When the power supply 106 is initially connected to a power source, the strings 102, 104 are energized and initially begin to emit light. Some LEDs change color and/or intensity during the first 3-5 minutes of energization and require about 30 minutes to reach steady state operation. During this start-up period prior to steady state operation, a current Ia flows through the first string 102 and the PTC component 302 e.g., thermistor T1 diverts at least part of the current Ia so that less than all of the current Ia flows through the second string 104. Thus, the PTC component 302 diverts current Ic so that Ia−Ic=Ib flows through the second string 104 during start-up.

The thermistor T1 is selected to have properties which correspond to the properties of the first string 102. In particular, as the thermistor T1 diverts current, it heats up and its resistance increases to a maximum rate over a period of time. The period of time is selected to be about the same as the period of time that it takes for the second string 104 to reach steady state.

The PTC component 302, e.g., thermistor T1, and resistor R4 provide a temperature signal 313 to the comparator 310. The temperature signal 313 corresponds to the temperature or state of operation of string 102. The comparator 310 is responsive to the temperature signal 313.

As thermistor T1 heats up and increases in resistance, the voltage drop across thermistor T1 increases so less voltage is applied to the positive input of the comparator 310 via divider resistors R5 and R6. When the applied voltage is less than the fixed voltage applied to the negative input of comparator 310 from resistor R4 and diode 314, the comparator output goes low to open MOSFET 304 and increase Rds to a maximum. The time when the applied voltage is greater than the fixed voltage corresponds to the time when the LEDs of string 102 have reached steady state operation. Thus, shunting by the thermistor T1 and MOSFET 304 is eliminated by the high resistance of thermistor T1 and by the high Rds of MOSFET 304 which essentially open-circuits any shunting or limiting. Any losses due to thermistor T1 are essentially eliminated In summary, referring to FIGS. 1-3, one embodiment comprises a light engine 100, 200, 300 an array of LEDs comprising at least one first string 102 of first LEDs 102A-D connected in series. When energized, the first LEDs output light having a first wavelength range. The light engine 100 also includes at least one second string 104 of second LEDs 104A-D connected in series. When energized, the second LEDs output light having a second wavelength range different from the first wavelength range. As illustrated, the second string 104 is connected in series with one first string 102, although more than two strings may be connected in series. A power supply 106 is connected to the array for connection to a power source for energizing the LEDs. A control circuit 108, 208, 308 is connected to the array comprising a positive temperature coefficient (PTC) component 202, 302 and a switch 204, 304 selectively connecting the PTC component to the array. The control circuit controls the switch 204, 304 as a function of a temperature circuit 208, 308. The temperature circuit 208, 308 is indicative of the temperature of at least one of the LEDs. The control circuit 108, 208, 308 limits the current applied to at least some of the LEDs 104 during initial energization of the LEDs prior to steady-state operation of the LEDs. In particular, the control circuit 108, 208, 308 controls the switch 204, 304 such that the PTC component 202 shunts the current applied to a first plurality of the LEDs 104 during initial energization of the LEDs prior to steady-state operation of the LEDs and such that shunting by the PTC component is substantially eliminated during steady-state operation of the LEDs. As a result, variations over time of a color correlated temperature (CCT) of output light of the energized array are reduced.

In some configurations of FIGS. 2 and 3, a varying voltage is applied to thermistor T1 from the power supply 106 because of a varying voltage drop across string 102 as string 102 heats up. Initially, the voltage applied to thermistor T1 may be less than the steady state voltage so that this may be taken into account when configuring the components.

In one embodiment, the comparators 210, 310 may be an operational amplifier, such as a general purpose op amp with an input voltage rating of ±15. A linear amplifier, UA741, made by TI may be used as the comparator.

FIG. 4 is schematic diagram of one embodiment of a light engine 400 having multiple parallel LED strings. An array of LEDs comprising at least one first string 402 of first LEDs 402A-B is connected in series. When energized, the first LEDs output light having a first wavelength range. The light engine 400 also includes at least one second string 404 of second LEDs 404A-C connected in series. When energized, the second LEDs output light having a second wavelength range different from the first wavelength range. As illustrated, the second string 404 is connected in series with one first string 402, although more than two strings may be connected in series. A power supply 407 is connected to the array for connection to a power source for energizing the LEDs. A control circuit 406 is connected to the array comprising a negative temperature coefficient (NTC) component 410 and a switch 416 selectively connecting the NTC component 410 to the array. The control circuit controls the switch 416 as a function of a temperature circuit 408. The temperature circuit 408 is indicative of the temperature of at least one of the LEDs. The control circuit 406 limits the current applied to at least some of the LEDs 402, 404 during initial energization of the LEDs prior to steady-state operation of the LEDs. In particular, the control circuit 406 controls the switch 416 such that the NTC component 410 limits the current applied to a first plurality of the LEDs 402, 404 during initial energization of the LEDs prior to steady-state operation of the LEDs. As the circuit continues to operate, the current through NTC thermistor 410 heats the thermistor causing its resistance to decrease. As a result, more current flows through NTC component 410 and strings 402, 404 such that current limiting by the NTC component is substantially eliminated during steady-state operation of the LEDs. As a result, variations over time of a color correlated temperature CCT of output light of the energized array are reduced.

In one embodiment, the NTC component comprises an NTC thermistor 410 and the switch comprises a MOSFET 416 connected in parallel to the NTC component 410. The MOSFET 416 is controlled by a temperature circuit. Circuits similar to the temperature sensitive circuits 208, 308 and comparators 210, 310, shown in FIGS. 2 and 3, may be connected to the MOSFET 416 to reduce the Rds of the MOSFET 416 as the circuit operates to selectively shunt the NTC thermistor 416. For example, the temperature sensitive circuit 208 with its inputs reversed may control MOSFET 416. The fixed voltage from divider resistors R1 and R2 would be applied to the negative input of comparator 210 and the temperature signal 213 would be applied to the positive input of comparator 210. Initially, the fixed voltage would be greater than the temperature signal 213 so that the comparator output 210 would apply little or no gate voltage to MOSFET 416. As a result, its Rds would be high. As the temperature signal increases, Rds would decrease shunting the current around the NTC component 410. Alternatively, a digital potentiometer or a microprocessor circuit may be used as temperature circuits 408.

The light engine 400 has at least a third string 412 of third LEDs 412A-C connected in series which, when energized, output light have the first wavelength range and a fourth string 414 of fourth LEDs 414A-B connected in series which, when energized, output light have the second wavelength range. The fourth string 414 is connected in series with the third string 412 and the third and fourth strings connected in parallel to the first 402 and second strings 404. Additional strings such as strings 422, 424 may be connected in parallel with the other strings.

The control circuit 406 comprises the NTC component 410 connected in series with the first string 402 and in series with second string 404 for selectively reducing the current applied to the first and second strings. The first string 402 has fewer LEDs than the third string 412 and the second string 404 has more LEDs than the fourth string 414 so that, as illustrated in FIG. 4, the number of LEDs in the first and third strings 402, 412 equals the number of LEDs in the second and fourth strings 404, 414. In general, the total number of LEDs of each color does not necessarily need to be the same and a particular string may have more than one color LED. The NTC component comprises an NTC thermistor 410 connected in series with the first and second strings 402, 404. The MOSFET 416 selectively bypasses the NTC thermistor 410.

In operation of FIG. 4, the NTC component 410 and MOSFET 416 operate similarly as noted above regarding FIGS. 2 and 3. As the temperature of the strings 402 and 404 and the NTC component 410 increases, the resistance of the NTC component 410 decreases until the temperature circuit 408 controlling the MOSFET 416 fully closes the MOSFET to bypass the NTC component 410. In FIG. 4, the MOSFET is configured to transition oppositely as compared to the MOSFETS in FIGS. 2 and 3. In FIGS. 2 and 3, the MOSFET transitions to an open-circuit as the circuit temperature increases. In FIG. 4, the MOSFET transitions to a closed circuit as the circuit temperature increases.

As a specific example regarding FIG. 4, consider the first string 402 to be mint (green) LEDs and the second string 404 to be red (amber) LEDs. The circuit has multiple LED strings 412, 414, 422, 424 plus N additional strings 422-1, 424-1 . . . 422-N, 424-N (where N is a positive integer) connected in parallel. In each string, the LEDs are two or more colors but one of the LED colors is selected as the primary contributor and other colors are the subordinate contributors. As noted above, when the LED temperature rises, the light output of one color decreases more severely than that of other colors. In this multiple string configuration of FIG. 4, with each string having one color as the primary contributor, the temperature sensitive component 410 is employed with the control circuit t 408 to control the current that flows in strings 402 and 404 to correct and stabilize the CCT of the light output during operation.

In the first string, the mint LEDs 402 are the subordinate contributors and the red LEDs 404 are the primary contributors. In the other strings, the mint LEDs, 412, 422-1, . . . , 422-N are the primary contributors and the red LEDs, 414, 424-1, . . . , 424-N are the subordinate contributors. An NTC thermistor 410 is connected in series with strings 402 and 404. Without any compensation, as the red and green LEDs of strings 402, 404, 412, 414, 422, 424 warm up, the red light output from the red LEDS decreases at a greater rate than the decrease in green light output from green LEDs, so that it will appear that the CCT of total output light is shifting from red to green.

In contrast, according to the embodiment of FIG. 4 including compensation, the resistance of the NTC thermistor 410 will decrease with increasing temperature, so the current flowing into strings 402, 404 including three red LEDs increases. Since the three red LEDs are the primary contributors in strings 402, 404, the increased red light balances the increased percentage of green light from the remaining strings as the remaining strings heat up. Therefore, the CCT shift will be compensated and corrected during the warm up. After the system reaches steady state and temperature stability, the MOSFET control circuit 406 will close to shunt all of the current normally carried by the thermistor 410, effectively removing the thermistor 410 from the circuit so that, in steady-state operation, any losses due to the thermistor are eliminated. The number of each type of LEDs and the arrangement of LEDs in each string are configured so that in steady-state operation with the MOSFET shunting the current around the thermistor, the required CCT/color coordinates of the light is achieved. Thus, the red and green LEDs of circuit 400 have optical properties which compliment each other and are balanced in light output as the circuit heats up to steady state.

Figure 5:
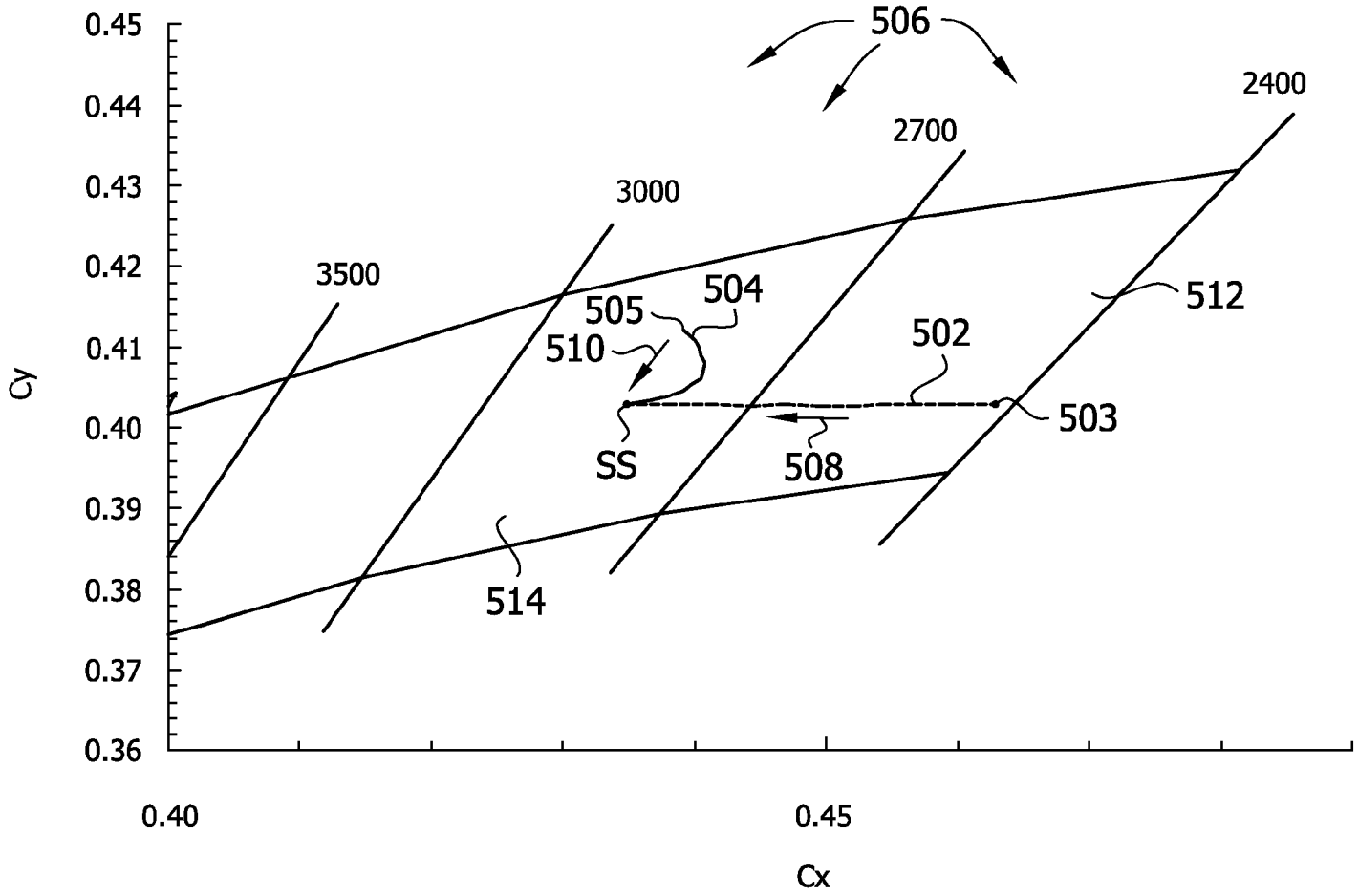
FIG. 5 is a graph illustrating temperature shifts in CCT/color coordinates of an LED string with current limiting according to one embodiment and of an LED string without current limiting.

FIG. 5 is a graph illustrating temperature shifts in CCT/color coordinates relative to ANSI binning. FIG. 5 illustrates shifts of an LED string comprising mint and red LEDs with limiting according to one embodiment and of an LED string comprising mint and red LEDs without limiting. Dashed line 502 shows the temperature shifts of an LED string, such as string 422 without any limiting, as the LEDs are energized from start-up to steady state. The line 502 shows that the LEDs have a wide color temperature change. ANSI bin 512 is between 2400° K and 2700° K of color temperature and ANSI bin 514 is between 2700° K and 3000° K of color temperature. Arrow 508 indicates the direction of the change in temperature. In operation, as shown in FIG. 5, the LEDs without limiting as shown by line 502 change in temperature from ANSI bin 512 at point 503 to ANSI bin 514 at steady state SS, from about 2400° K to about 2850° K.

Figure 6:
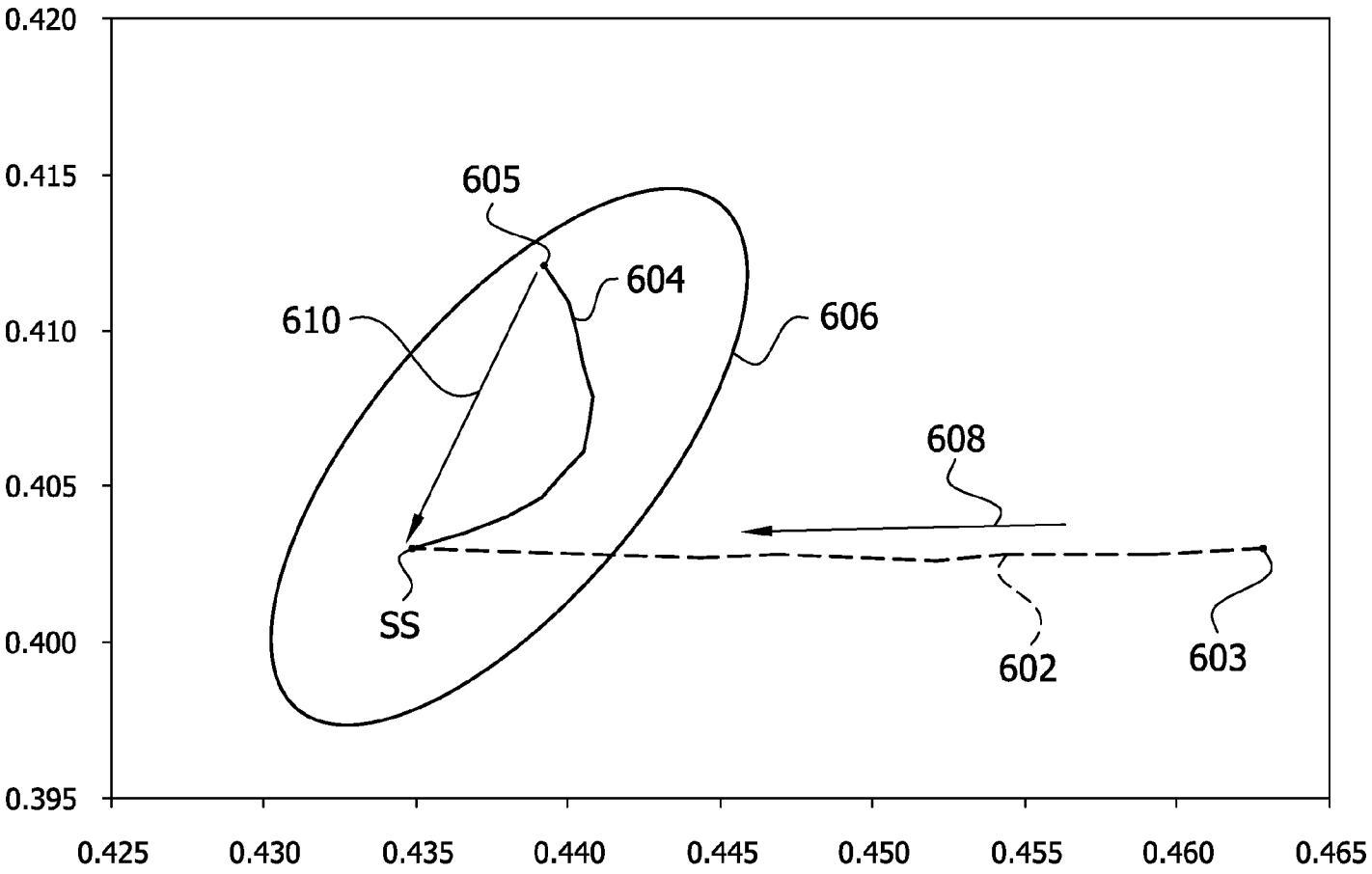
FIG. 6 is another graph including a 3-step MacAdam ellipse illustrating temperature shifts in CCT/color coordinates of an LED string with current limiting according to one embodiment of an LED string without current limiting.

FIG. 6 is another graph illustrating temperature shifts in CCT/CIE xy chromaticity diagram of an LED string comprising mint and red LEDs with limiting according to one embodiment and of an LED string comprising mint and red LEDs without limiting, relative to a 3-step MacAdam ellipse 606. Dashed line 602 shows the temperature shifts of an LED string, such as string 422 without any limiting, as the LEDs are energized from start-up to steady state. The line 602 shows that the LEDs have a wide color temperature change. Arrows 508, 608 indicate the direction of the change in temperature. As shown in FIG. 6, the LEDs without limiting as shown by line 602 change in temperature from beyond the 3-step MacAdam ellipse 606 at point 603 to within the ellipse at steady state SS. Changes within a 3-step MacAdam ellipse are not perceptible by an observer. Since line 602 extends beyond the MacAdam ellipse 606 to within it, this means that the color change would perceptible by an observer.

In contrast, solid lines 504, 604 show the temperature shifts of an LED string, such as string 102,104 or strings 402-424 with limiting as noted above in FIGS. 1-4 (as the LEDs are energized from start-up to steady state). The lines 504, 604 show that the LEDs with limiting have a narrower temperature change than LEDs without limiting. Arrows 510, 610 indicate the direction of the change in temperature. Line 502 starts at point 503 which is a different temperature than the start point 505 of line 504 because line 502 illustrates no current limiting whereas line 504 indicates current limiting as noted in FIGS. 1-4. Lines 502 and 504 end at the same steady state point SS indicating steady state operation. Similarly, line 602 starts at point 603 which is a different temperature than the start point 605 of line 604 because line 602 illustrates no current limiting whereas line 604 indicates current limiting as noted in FIGS. 1-4. Lines 602 and 604 end at the same point SS indicating steady state operation.

As shown in FIG. 5, the LEDs with limiting as shown by line 504 vary in temperature within ANSI bin 514 from about 2800° K to about 2850° K which means that the LEDs are color corrected from start up to steady state so that the color change is relatively small. As shown in FIG. 6, the LEDs with limiting as shown by line 604 vary in temperature within the 3-step MacAdam ellipse 606 which means that the LEDs are color corrected from start up to steady state so that the color change would not be perceptible by an observer.

It is contemplated that there could be other configurations that do not use thermistors and instead use other electronic devices with temperature dependent variables to realize the temperature dependent limiting functions noted above.

The order of execution of the operations in embodiments described herein is not essential, unless otherwise specified. Operations may be performed in any order, unless otherwise specified, and embodiments may include additional or fewer operations than those disclosed. For example, it is contemplated that performing a particular operation before, contemporaneously with, or after another operation is within the scope of aspects of the claims.

When introducing elements of aspects or the embodiments thereof, the articles "a," "an," "the," and "said" are intended to mean that there are one or more of the elements. The terms "comprising," "including," and "having" are intended to be inclusive and mean that there may be additional elements other than the listed elements.

Not all the components described may be required. Some embodiments may include additional components. Variations in the arrangement of the components may be made without departing from the scope of the claims. Additional, different or fewer components may be provided, and components may be combined or implemented by several components.

The above description illustrates by way of example and not by way of limitation. This description enables one skilled in the art to make and use the disclosure, and describes several embodiments and variations, including what is presently believed to be the best mode of carrying out the disclosure. The disclosure is not limited in its application to the details of construction and the arrangement of components in the description or illustrated in the drawings. The disclosure is capable of other embodiments and of being practiced differently. The terminology used herein should not be regarded as limiting. Having described aspects in detail, it is apparent that modifications are possible without departing from the scope of aspects as defined in the claims. It is intended that all matter contained in the above description and shown in the accompanying drawings shall be interpreted as illustrative and not in a limiting sense.

GLOSSARY

The following is a representative, non-limiting list of the reference numerals noted above.

100 light engine
102 first string
102A-D first LEDs
104 second string
104A-D second LEDs
106 power supply
108 control circuit
110 temperature circuit
111 current limiting circuit
112 temperature signal
200 light engine
202 PTC (+t°) component
204 switch (MOSFET)
206 shunting circuit
208 first temperature sensitive circuit
209 switching circuit
210 comparator
212 second temp. sensitive circuit
213 temperature signal
214 voltage circuit
216 NTC (−t°) component
300 light engine
302 PTC (+t°) component
304 switch
306 shunting circuit
308 temperature sensitive circuit
309 switching circuit
310 comparator -continued 312 resistive array
313 temperature signal
314 voltage regulating diode
400 light engine
402 first string
402A-402B first LEDs
404 second string
404A-C second LEDs
406 control circuit
407 power supply
408 temperature circuit
410 NTC (−t°) thermistor
412 third string
412A-412C third LEDs
414 fourth string
414A-414B fourth LEDs
416 switch
422-424 additional strings
502 dashed line w/o shunting
503 start of line 502
504 solid line with shunting
506 ANSI bins
508, 510 arrows
512-514 ANSI bins
602 dashed line w/o shunting
603 start of line 602
604 solid line with shunting
606 3-step MacAdam ellipse
608, 610 arrows
SS steady state (end of lines 502, 504, 602, 604)
R1-R6 resistors
VT2 voltage drop across T2
VR3 voltage drop across R3
Rds drain-source resistance
RT2 resistance of T2
T1 PTC thermistor
T2 NTC thermistor

We claim:

1. A light engine (100; 200; 300; 400) comprising:

an array of LEDs comprising at least one first string (102; 402) of first LEDs (102A-D; 402A-B) connected in series which, when energized, output light having a first wavelength range and comprising at least one second string (104; 404) of second LEDs (104A-D; 404A-C) connected in series which, when energized, output light having a second wavelength range different from the first wavelength range, wherein said at least one second string (104; 404) is connected in series with said at least one first string (102; 402);

a power supply (106; 406) connected to the array for connection to a power source for energizing the LEDs;

a control circuit (108; 206; 306; 406) connected to the array comprising a temperature variable resistance component (202; 302; 410) and a switch (204; 304; 416) selectively connecting the temperature variable resistance component to the array, the control circuit controlling the switch (204; 304; 416) as a function of a temperature circuit (208; 308) indicative of the temperature of at least one of the LEDs, wherein the control circuit limits the current applied to at least some of the LEDs (104; 402, 404) during initial energization of the LEDs prior to steady-state operation of the LEDs whereby variations over time of a color correlated temperature (CCT) of output light of the energized array are reduced.

2. The light engine (100; 200; 300; 400) of claim 1 wherein the control circuit (108; 208; 308; 408) controls the switch (204; 304; 416) such that the temperature variable resistance component (202; 302; 410) limits the current applied to a first plurality of the LEDs (104; 402, 404) during initial energization of the LEDs prior to steady-state operation of the LEDs and such that limiting by the temperature variable resistance component is substantially eliminated during steady-state operation of the LEDs.

3. The light engine (400) of claim 1 wherein the temperature variable resistance component comprises an NTC thermistor (410) and the switch comprises a MOSFET (416) connected in parallel to the NTC component (410); and further comprising a temperature sensitive circuit (208; 308) connected to the MOSFET for selectively opening and closing the MOSFET to selectively limit the current to at least some of the LEDs.

4. The light engine of claim 1 wherein the array further comprises:

a third string (412) of third LEDs (412A-C) connected in series which, when energized, output light have the first wavelength range;

a fourth string (414) of fourth LEDs (414A-B) connected in series which, when energized, output light have the second wavelength range, the fourth string (414) connected in series with the third string (412) and the third and fourth strings connected in parallel to the first (402) and second strings (404).

5. The light engine of claim 4 wherein the control circuit (408) comprises an NTC component (410) connected in series with the first and second strings (402, 404) for selectively reducing the current applied to the first and second strings and wherein the first string (402) has fewer LEDs than the third string (412) and the second string (404) has more LEDs than the fourth string (414) and such that the light output of LEDs in the first and third strings (402, 412) balances the light output of LEDs in the second and fourth strings (404, 414).

6. The light engine of claim 5 wherein the temperature variable resistance component comprises an NTC thermistor (410) connected in series with the first and second strings (402, 404) and a MOSFET (416) connected in parallel with the NTC thermistor, wherein the MOSFET (416) selectively bypasses the NTC thermistor (410).

7. A light engine (100; 200; 300) comprising:

a first string (102) of first LEDs (102A-102D) connected in series which, when energized, output light having a first wavelength range;

a second string (104) of second LEDs (104A-104D) connected in series which, when energized, output light having a second wavelength range different from the first wavelength range, the second string (104) connected in series with the first string (102);

a power supply (106) connected to the first and second strings for connection to a power source for energizing the strings; and a control circuit (108) comprising a temperature circuit (110) providing a temperature signal (112) indicative of the temperature of at least one of the LEDs (102, 104), the control circuit (108) responsive to the temperature circuit (110) for selectively controlling a current applied to the second string (104) via the power supply (106) as a function of the temperature signal (112), wherein the control circuit (108) controls the current during initial energization of the LEDs (102, 104) prior to steady-state operation of the LEDs (102, 104) whereby variations over time of a color correlated temperature (CCT) of output light of the energized LEDS (102, 104) is reduced.

8. The light engine of claim 7 wherein the temperature circuit comprises an PTC (positive temperature coefficient) component (202; 302) in parallel with the second string (104) and in series with a switch (204; 304) and wherein the control circuit (108) controls the switch (204; 304) such that the PTC component (202, 302) shunts the current applied to the second string (104) during initial energization of the LEDs (102, 104) prior to steady-state operation of the LEDs (102, 104) and such shunting by the PTC component is substantially reduced during steady-state operation of the LEDs.

9. The light engine of claim 7 wherein the control circuit (108) comprises a shunting circuit (111; 206; 306) for shunting a portion of the current applied to the second string, the shunting circuit (206; 306) comprising:

a first temperature sensitive circuit (208; 308) connected between the first and second strings (104, 106) for shunting the portion of the current applied to the second string (106); and a switching circuit (209; 309) in series with the first temperature sensitive circuit (208; 308) for selectively disabling the first temperature sensitive circuit.

10. The light engine (200) of claim 9 wherein the switching circuit (209) includes a MOSFET (204) in series with at least a part of the first temperature sensitive circuit (208) for selectively providing an open circuit, and includes a comparator (210) responsive to a second temperature sensitive circuit (212) for controlling the MOSFET (204), said second temperature circuit (212) being a part of the first temperature sensitive circuit (208).

11. The light engine (200) of claim 10 wherein the first temperature sensitive circuit (208) comprises a first PTC (positive temperature coefficient) component (202), wherein the first PTC component (202) is connected in series with the MOSFET (204) and wherein the second temperature sensitive circuit comprises a voltage circuit (214) comprising a constant voltage source (VCC) and a second temperature variable resistance component (216) connected to the constant voltage source (VCC) to provide the temperature signal (213), wherein the temperature variable resistance component is connected to an input of the comparator (210) for controlling the MOSFET (204).

12. The light engine (300) of claim 9 wherein the first temperature sensitive circuit (308) comprises a PTC thermistor (302) and wherein the switching circuit (309) includes a MOSFET (304) in series with the PTC thermistor (302) for selectively providing an open circuit, and includes a comparator (310) responsive to a voltage circuit (312) for controlling the MOSFET (304).

13. The light engine (300) of claim 12 wherein the voltage circuit (308) comprises a resistive array (312) connected between the PTC thermistor (302) and the MOSFET (304) providing the temperature signal (313) to the comparator (310).

14. The light engine (100; 200; 300) of claim 7 wherein the first wavelength range comprises green light and wherein the second wavelength range comprises red light.

15. The light engine (100; 200; 300) of claim 7 wherein the control circuit (108) comprises an PTC thermistor (202; 302) and a MOSFET (204; 304) in series with the PTC thermistor (202; 302), wherein a comparator (210; 310) controls the MOSFET and wherein the PTC thermistor (202; 302) and the MOSFET (204; 304) are in parallel with the second string (104).

16. The light engine (100; 200; 300; 400) of claim 2 wherein said first plurality of the LEDs (104; 402, 404) comprises a portion of the LEDs in said array of LEDs, said portion being is less than all the LEDs in said array of LEDs.

* * * * *